US006305859B2

(12) United States Patent
Shida

(10) Patent No.: US 6,305,859 B2
(45) **Date of Patent: *Oct. 23, 2001**

(54) PRESSURE CONTACT ROLLER AND PRINTER USING THE SAME

(75) Inventor: Mitsuru Shida, Iwate-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/440,921

(22) Filed: Nov. 16, 1999

(30) Foreign Application Priority Data

Nov. 18, 1998 (JP) ..... 10-327740

(51) Int. Cl.[7] ..... B41J 13/076
(52) U.S. Cl. ..... 400/636; 400/637; 400/639
(58) Field of Search ..... 400/639, 639.1, 400/638, 637, 636.1, 636, 634; 492/30, 59

(56) References Cited

U.S. PATENT DOCUMENTS 4,601,595 * 7/1986 Aiba et al. ..... 400/637
5,049,944 * 9/1991 DeBolt et al. ..... 355/284
5,364,697 * 11/1994 Miyabayashi ..... 428/323
5,417,158 * 5/1995 Parsio ..... 101/232
5,782,730 * 7/1998 Kawasaki et al. ..... 482/56
5,790,926 * 8/1998 Mizoe et al. ..... 399/174
5,803,887 * 9/1998 Fukunaga ..... 492/59
5,975,638 * 10/1999 Saito et al. ..... 400/636
6,029,040 * 2/2000 Yamada et al. ..... 399/325
6,105,249 * 8/2000 Ando et al. ..... 29/895

FOREIGN PATENT DOCUMENTS 8-156359 6/1996 (JP) .
9-278220 10/1997 (JP) .

* cited by examiner

*Primary Examiner*—John S. Hilten
*Assistant Examiner*—Anthony H. Nguyen
(74) *Attorney, Agent, or Firm*—Brinks Hofer Gilson & Lione

(57) ABSTRACT

The invention provides a pressure contact roller for use in a recording paper feeding mechanism of a printer, the pressure contact roller is formed with crystalline resin powder projected from an outer circumferential surface of the roller body. By using the pressure contact roller, a printer is provided which can effectively prevent ink on the recording surface of a sheet of recording paper from drifting to the outer circumferential surface of the pressure contact roller, and can print high-quality full-color image free from unevenness in recording density.

11 Claims, 5 Drawing Sheets

| AMOUNT OF MIXED UHMWPE (phr) | RECORDING QUALITY | COLOR DIFFERENCE(ΔE) |
|---|---|---|
| 0 | × | 3～4 |
| 10 | × | 1～2 |
| 30 | × ～ △ | 0.5 ～1.5 |
| 50 | ○ | 0.2 ～1.5 |
| 70 | ○ | 0.2 ～1.5 |

PRESSURE CONTACT ROLLER AND PRINTER USING THE SAME

BACKGROUND OF THE INVENTION

1. Field of the Invention

The present invention relates to a pressure contact roller for use in a feed mechanism for advancing a sheet of recording paper to a recording position in a printer with roller rotation, and more particularly to a pressure contact roller formed using an elastomer material. The present invention also relates to a printer using such a pressure contact roller.

2. Description of the Related Art

A thermal transfer printer 51 shown in FIG. 9 has been hitherto employed as a recording apparatus in which full-color recording is performed by superimposing thermally sublimating or thermally fusing inks of plural colors successively on a sheet of recording paper.

The thermal transfer printer 51 has a platen 53 in the form of a flat plate disposed at a desired position on a frame 52. In front of the platen 53, a carriage shaft 54 is disposed parallel to the platen 53. A carriage 55 mounting a thermal head 56 thereon is attached to the carriage shaft 54 such that the carriage 55 is able to reciprocate along the carriage shaft 54.

Plural kinds of ribbon cassettes including ink ribbons of different colors set in a coiled state can be mounted on the carriage 55 successively in predetermined order for full-color recording. Behind the platen 53, feed rollers 57 are disposed to be rotatable by a paper feed motor (not shown) to advance a sheet of recording paper to a gap between the platen 53 and the thermal head 56. In the full-color recording, one kind of ribbon cassette is mounted on the carriage 55, and each time one recording cycle using the ink ribbon in the mounted ribbon cassette is completed, the feed roller 57 is rotated so as to return the recording start line (first line) on the sheet of recording paper to the position between the platen 53 and the thermal head 56 in a repeated manner.

Pressure contact rollers 58 are rotatably disposed near the feed rollers 57, and are held in pressure contact with outer circumferential surfaces of the corresponding feed rollers 57 to cooperatively advance the sheet of recording paper while the sheet between the pressure contact rollers 58 and the feed rollers 57. When the feed rollers 57 are rotated to advance the sheet of recording paper, one surface of the sheet of recording paper, on which recording is made, contacts outer circumferential surfaces of the pressure contact rollers 58. In full-color recording, therefore, the outer circumferential surfaces of the pressure contact rollers 58 come into contact with the recording surface several times on which recording has been already made with ink impregnated in the ink ribbon.

Generally, the pressure contact rollers 58 are each manufactured by forming a rod-like roller shaft by resin molding, and then integrally forming a substantially cylindrical roller body made of an elastomer material over an outer circumference of the roller shaft. Because the recording surface of a sheet of recording paper, on which recording is made, contacts the outer circumferential surfaces of the pressure contact rollers 58 as described above, the pressure contact rollers 58 require to be made of such a one of elastomer materials as not affecting the recording surface. More specifically, elastomer materials each usually contain chemicals, e.g., a plasticizer and a coupling agent, for adjustment of hardness. When the pressure contact rollers 58 containing those chemicals come into contact with, as one example of recording paper, a sheet of paper specific for thermal sublimation recording in which an ink dyed layer is formed on the paper surface, the ink dyed layer is swollen due to the chemicals in the pressure contact rollers 58. In the sublimation transfer process of ink, therefore, the amount of ink dyed into the swollen dyed layer is increased and recording at a desired density cannot be achieved.

For the above reason, amide-based thermoplastic elastomers of the plasticizer-free type containing no contaminant components, e.g., a plasticizer and a coupling agent, have been hitherto used as the elastomer materials of the pressure contact rollers 58.

Paper supply rollers 61 are disposed behind the feed rollers 57, and are rotatable by the paper feed motor to supply a sheet of recording paper to the pressure contact position between the feed rollers 57 and the pressure contact rollers 58.

In a rear end portion of the frame 52 behind the paper supply rollers 61, a recording paper holding plate 62 is disposed to hold sheets of recording paper on which recording is to be made by the thermal head 56.

When an image is recorded with the thermal transfer printer 51 including the pressure contact rollers 58 described above, the pressure contact rollers 58 free from contaminant components impose no effects upon the recording paper, and therefore a good full-color image can be obtained.

The conventional pressure contact rollers 58, however, have a problem as follows. Upon the recording surface of a sheet of recording paper, on which recording has been already made, contacting the outer circumferential surfaces of the pressure contact rollers 58, the ink transferred onto the recording surface drifts to the outer circumferential surfaces of the pressure contact rollers. Accordingly, the recording density in areas of the recording surface of the sheet of recording paper from which the ink has drifted becomes lower than that in the remaining area of the recording surface which does not contact the pressure contact rollers.

It is known that the amount of ink drift depends on the amount of hard segment (i.e., the amount of crystal component) contained in the elastomer material of each pressure contact roller. Because the amount of hard segment is a value proportional to the hardness of the elastomer material, it can be said that the amount of ink drift depends on the hardness of the elastomer material. More specifically, FIG. 8 shows data indicating the correlation between material hardness and ink drift resulted from experiments made using three kinds of elastomer materials, i.e., Aramid, Hytrel (polyester-based elastomer) Hytrel is a name of a product made by DuPont-Tray Co., Ltd. Diamid is a name of a product made by Daicel-Huls Ltd. and Diamid (polyamide-based elastomer). As seen from the data of FIG. 8, there is such a tendency that the smaller the material hardness, the greater is the drift of ink to the elastomer material. Note that, in FIG. 8, the ink drift distance, i.e., the distance in the direction of row over which the ink has drifted to the pressure contact roller, is employed as a parameter representing the drift of ink.

Accordingly, one conceivable method for preventing the ink drift is to increase the hardness of the pressure contact roller by coating a urethane- or silicone-based thermosetting surface treatment agent, for example, on the outer circumferential surface of the pressure contact roller. However, if the material hardness is too high, wear or abrasion due to pressure contact with the feed roller 57 is overly increased.

A feed roller of projection type having a number of projections formed on the outer circumferential surface in a zigzag pattern has been recently employed to enhance the force of gripping a sheet of recording paper. In the case of employing such a feed roller, particularly, a possibility of causing wear or abrasion of the pressure contact roller is further increased.

SUMMARY OF THE INVENTION

An object of the present invention is to provide a pressure contact roller which can prevent ink drift from the recording surface, and hence can produce a full-color image with high quality. Another object of the present invention is to provide a printer which can print a full-color image with high quality by using the pressure contact roller.

More specifically, the present invention provides a pressure contact roller which is formed such that crystalline resin powder is projected from an outer circumferential surface of a roller body.

The above feature of the present invention intends to increase the hardness of the pressure contact roller to such an extent as not causing an adverse effect of wear of a feed roller caused by the pressure contact roller upon contact between both the rollers.

Further, the present invention provides a pressure contact roller wherein the roller body is formed using a mixed material of the elastomer material and the crystalline resin powder.

The above feature of the present invention intends to increase the hardness of the pressure contact roller with a simple construction.

Still further, the present invention provides a pressure contact roller wherein resin powder of ultrahigh molecular weight polyethylene is used as the crystalline resin powder.

The above feature of the present invention intends to most effectively prevent ink drift to the pressure contact roller.

Moreover, the present invention provides a printer wherein the above pressure contact roller is used in a recording paper feeding mechanism of the printer.

The above feature of the present invention intends to prevent ink drift from the recording surface of a sheet of recording paper, and to print a full-color image with high quality.

DESCRIPTION OF THE PREFERRED EMBODIMENT

One embodiment of a pressure contact roller according to the present invention will be described below with reference to FIGS. 1 to 6.

A pressure contact roller 13 in this embodiment has a columnar roller shaft 14 formed by resin molding.

Over an outer periphery of the roller shaft 14, a roller body 15 having a cylindrical outer circumferential surface is formed integrally with the roller shaft 14 such that the roller body 15 has a larger diameter than that of the roller shaft 14. The roller body 15 is formed of a mixed material in which a thermoplastic elastomer and crystalline resin powder 16 are mixed with each other. Numerous particles of the crystalline resin powder 16 are projected from all over the outer circumferential surface of the roller body 15.

Any of Aramid, Hytrel (polyester-based elastomer) and Diamid (polyamide-based elastomer) can be used as the thermoplastic elastomer. From the standpoint of preventing contamination of recording paper, however, the thermoplastic elastomer is preferably formed of a material which contains no contaminant components such as a plasticizer and a coupling agent.

Figures 1, 2:
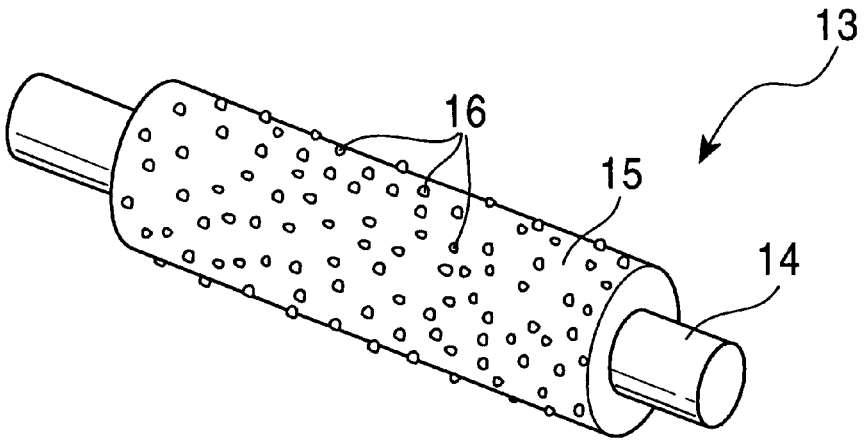
FIG. 1 is a perspective view showing an embodiment of a pressure contact roller according to the present invention.
FIG. 2 is a table showing the relationship between the amount of UHMWPE (Ultrahigh Molecular Weight Polyethylene) mixed in a roller body and recording quality in the embodiment of the pressure contact roller according to the present invention.
Figure 3:
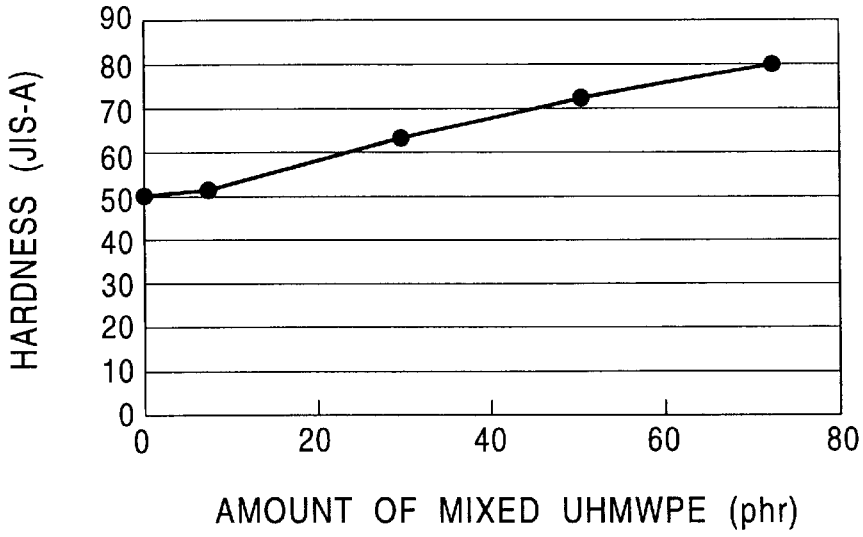
FIG. 3 is a graph showing the relationship between the amount of mixed UHMWPE and material hardness in the embodiment of the pressure contact roller according to the present invention.

The crystalline resin powder 16 may be any powder of polyethylene, ultrahigh molecular weight polyethylene (UHMWPE), polyimide resin, silicone resin, polyamide resin, polyacetal resin, PPS resin, and fluorine-contained resin. From the standpoint of optimally increasing the amount of hard segment (i.e., the amount of crystal component) in the pressure contact roller 13, this embodiment uses, as the crystalline resin power 16, resin powder of UHMWPE having the molecular weight of $200\times10^4$, the density of 0.94, the melting point of 136° C. and the mean radius of 30 $\mu$m. Further, FIG. 2 shows experimental data indicating the relationship between the amount of the crystalline resin powder 16 of UHMWPE mixed in the thermoplastic elastomer and recording quality. As seen from FIG. 2, it is desired that the amount of the crystalline resin powder 16 of UHMWPE mixed in the thermoplastic elastomer is in the range of approximately 50–70 phr (per hundred rubber). A color difference ($\Delta E$) in FIG. 2 is a value representing a difference between the recording density in an area of a sheet of recording paper which is subject to pressure contact with the pressure contact roller 13 and the recording density in an area of the sheet of recording paper which is not subject to pressure contact with the pressure contact roller 13. A smaller value of the color difference means better quality of a recorded image. In addition, when the amount of the mixed UHMWPE resin powder is in the above range, the pressure contact roller 13 has a relatively low hardness of approximately 70 degrees in terms of JIS-A hardness as shown in FIG. 3. Accordingly, there is substantially no need of considering wear or abrasion of the pressure contact roller 13 caused upon coming into pressure contact with a feed roller 7 (described later).

Figure 4:
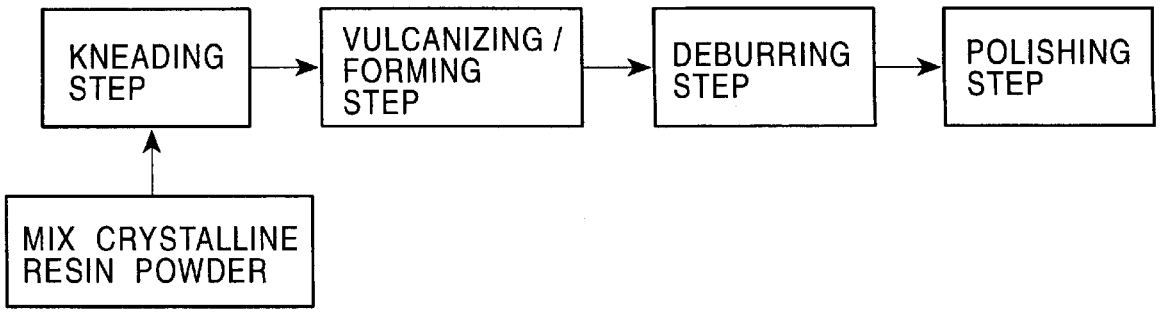
FIG. 4 is a block diagram showing manufacturing steps of the roller body in the embodiment of the pressure contact roller according to the present invention.

A method of manufacturing the roller body 15 will now be described. First, as shown in FIG. 4, in a kneading step, the UHMWPE resin powder 16 is mixed in the thermoplastic elastomer and homogeneously kneaded to produce a mixed material. Then, in a vulcanizing and forming step, the mixed material is formed into a desired shape by a known molding method, e.g., extrusion molding, while sulfur is added to the mixed material. The roller body 15 having a substantially cylindrical shape and having an outer circumferential surface with a larger diameter than the roller shaft 14 is thereby formed. Next, in a deburring step, unnecessary portions of the thus-formed roller body 15 are cut.

Figure 5:
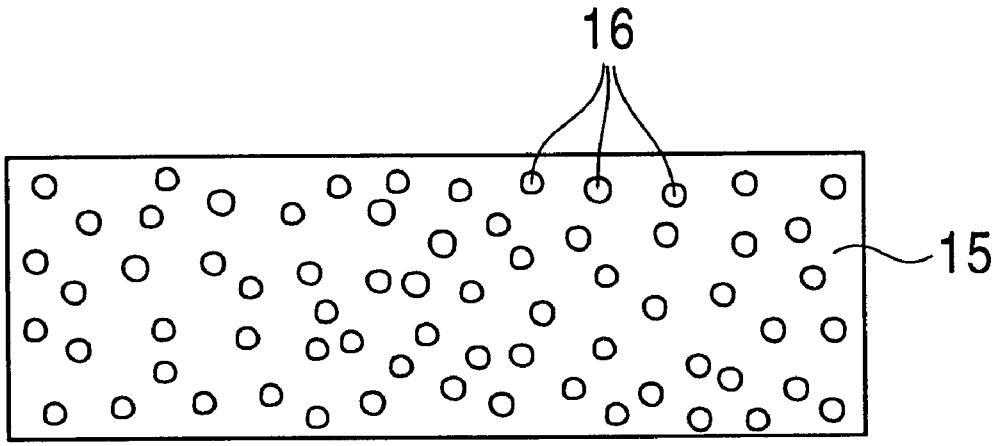
FIG. 5 is an illustration showing the vicinity of an outer circumferential surface of the roller body before polishing in the embodiment of the pressure contact roller according to the present invention.
Figure 6:
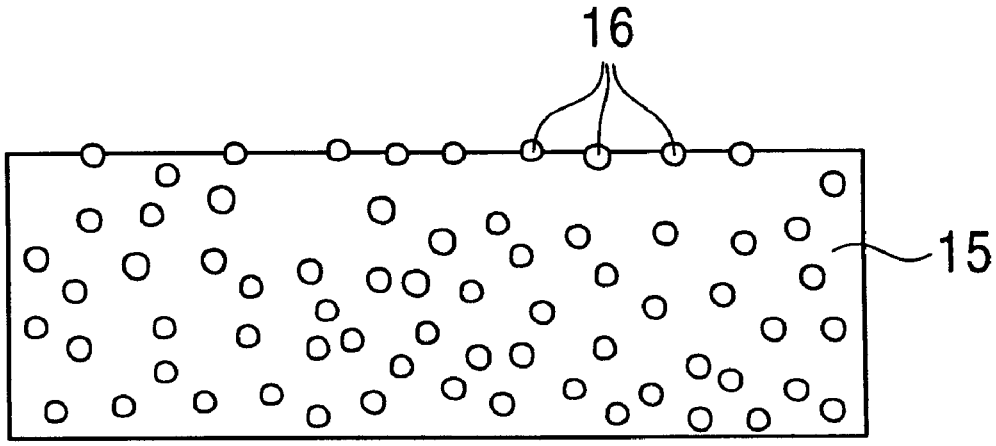
FIG. 6 is an illustration showing the vicinity of the outer circumferential surface of the roller body after polishing in the embodiment of the pressure contact roller according to the present invention.
Figure 7:
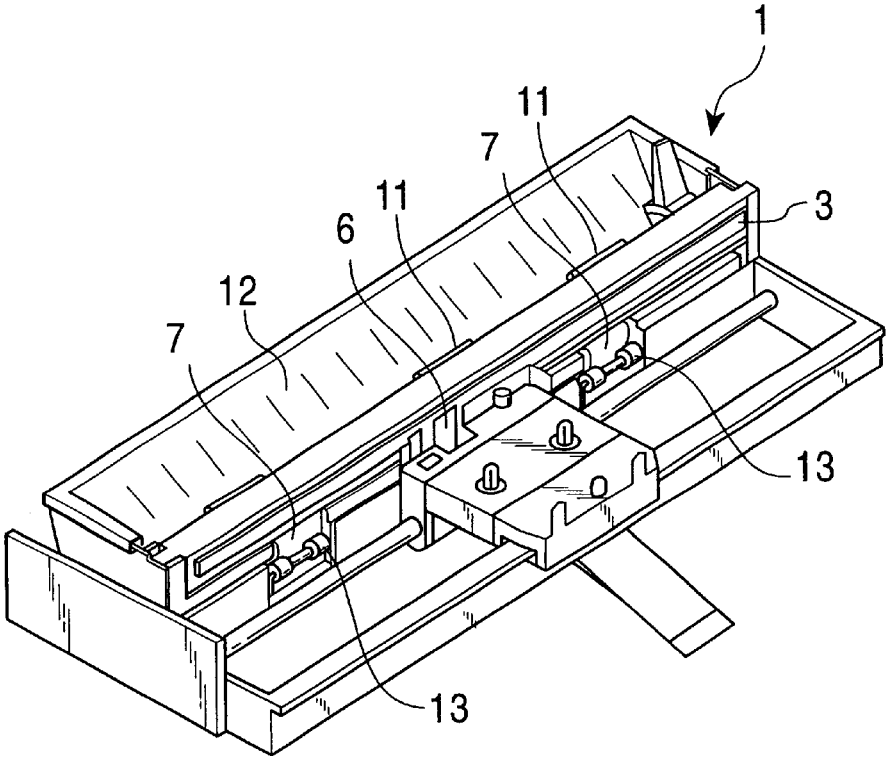
FIG. 7 is a perspective view showing a thermal transfer printer employing the pressure contact roller according to the present invention.

After the end of the foregoing steps, as shown in FIG. 5, the crystalline resin powder 16 of UHMWPE is in a condition that individual particles are buried in the roller body 15. Subsequently, in a polishing step, the outer circumferential surface of the roller body 15 is polished so that, as shown in FIG. 6, the crystalline resin powder 16 of UHMWPE is exposed to the outside at the outer circumferential surface of the roller body 15. As a result, the roller body 15 is completed in a condition that the numerous particles of the crystalline resin powder 16 of UHMWPE are projected from the outer circumferential surface of the roller body 15.

The operation of this embodiment of the present invention will now be described. Specifically, the operation of a thermal transfer printer 1 employing the pressure contact roller 13 according to this embodiment will be described.

First, a sheet of recording paper is placed on a recording paper holding plate 12 of the thermal transfer printer 1. Paper supply rollers 11 are then driven to supply the sheet of recording paper to a pressure contact position between feed rollers 7 and the pressure contact rollers 13. Subsequently, the feed rollers 7 are driven to feed the sheet of recording paper onto a platen 3 while the sheet is gripped between the feed rollers 7 and the pressure contact rollers 13. At this time, a ribbon cassette including an ink ribbon of one color (e.g., cyan) set therein is mounted on a carriage 5. The ink ribbon withdrawn out of the mounted ribbon cassette is brought into pressure contact with the sheet of recording paper, which is now fed onto the platen 3, upon head-down operation of the thermal head 6. Then, the carriage 5 is driven to move along the platen 3 while heat generating elements of the thermal head 6 are selectively energized to produce heat in accordance with recording information. As a result, the cyan ink is thermally transferred onto the recording surface of the sheet of recording paper, and thermal transfer recording of one line is made on the sheet of recording paper. By repeating the above operation for each line, thermal transfer recording using the cyan ink is completed for the sheet of recording paper.

Next, another ribbon cassette including an ink ribbon of different color (e.g., magenta) set therein is mounted on the carriage 5. At this time, the feed rollers 7 are rotated in a direction opposed to that in recording so that the recording start line (first line) on the recording surface, on which recording has been made with the cyan ink, is returned to that position between the thermal head 6 and the platen 3. During the returning movement, the recording surf ace on which recording has been made with the cyan ink is brought into pressure contact with the outer circumferential surfaces of the pressure contact rollers 13. However, the numerous particles of the crystalline resin powder 16 of UHMWPE are projected from the outer circumferential surfaces of the pressure contact rollers 13, and the crystalline resin powder 16 has a large amount of hard segment (i.e., a large amount of crystal component) and hence has a property to impede adhesion of the ink that has been thermally transferred onto the recording surface. As a result, the ink transferred onto the recording surface is prevented from drifting to the outer circumferential surfaces of the pressure contact rollers 13.

Figure 8:
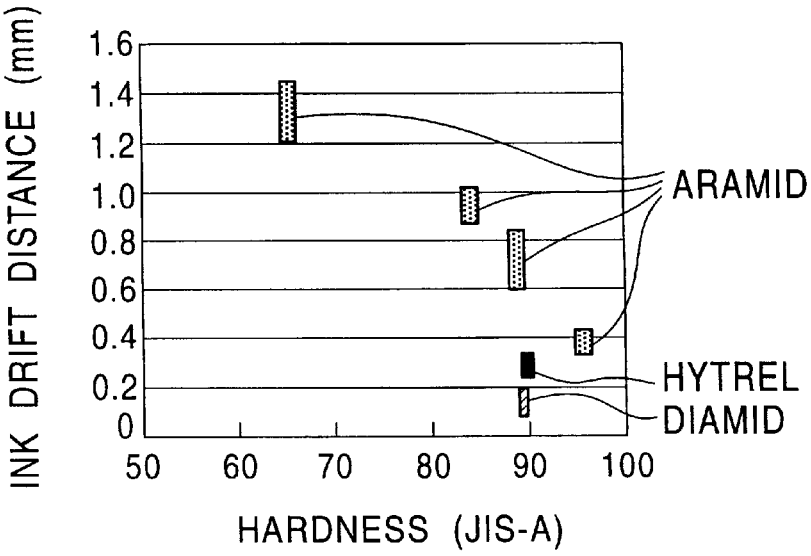
FIG. 8 is a graph showing the correlation between the hardness of an elastomer material used as a material of the pressure contact roller and the distance over which ink transferred onto the recording surface has drifted to the pressure contact roller.
Figure 9:
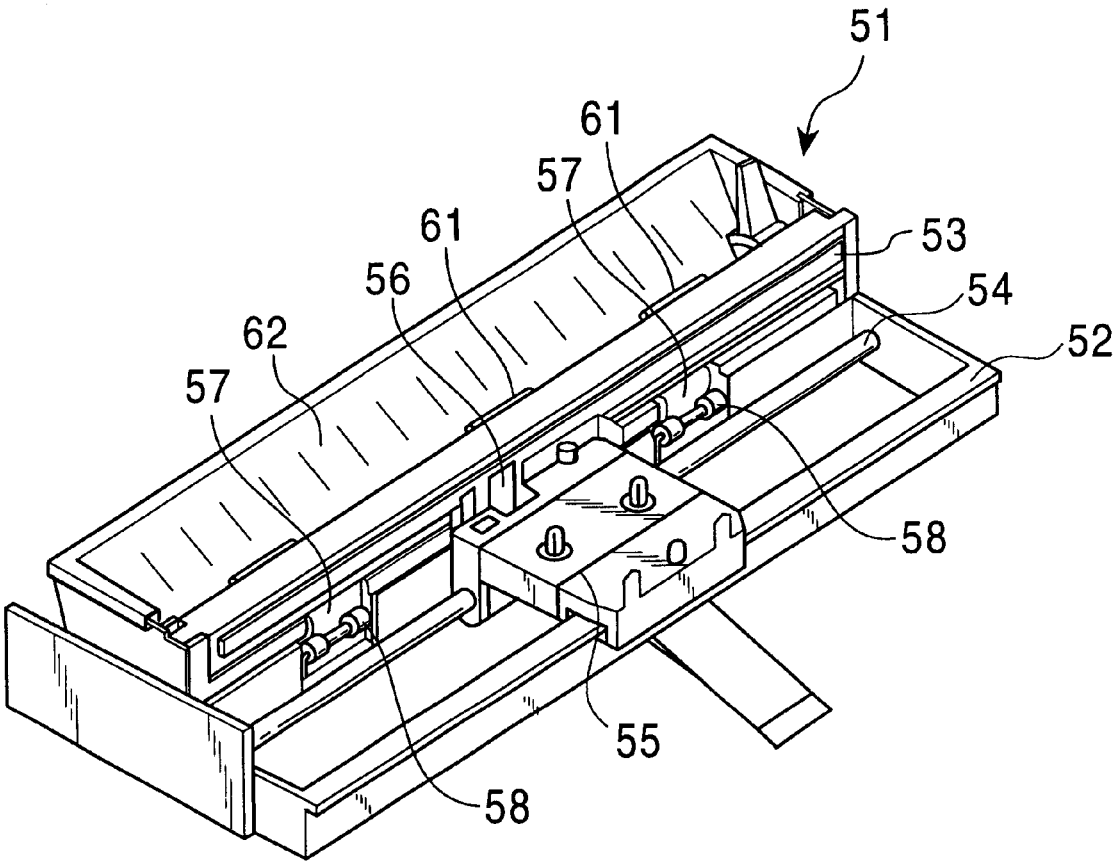
FIG. 9 PRIOR ART
FIG. 9 is a perspective view showing a thermal transfer printer employing a conventional pressure contact roller.

In full-color recording, since the above operation is repeated for each of the ribbon cassettes for different colors, the recording surface, on which recording has been made with each thermally sublimating ink in a superimposed manner, is brought into pressure contact with the outer circumferential surfaces of the pressure contact rollers 13. However, the numerous particles of the crystalline resin powder 16 of UHMWPE projected from the outer circumferential surfaces of the pressure contact rollers 13 function to prevent the ink from drifting to the pressure contact rollers 13, and therefore a full-color image is recorded on the sheet of recording paper with high quality free from unevenness in ink density. In addition, as shown in FIG. 8, the ink drift distance is reduced proportionally to the material hardness of the roller body 15. Thus, by mixing, in the thermoplastic elastomer, the crystalline resin powder 16 of UHMWPE that has a higher hardness in various kinds of polyethylene, the ink drift can be most effectively prevented among the cases of employing polyethylene crystalline resin powder.

With the embodiment of the present invention, therefore, the ink on the recording surface is prevented from drifting to the outer circumferential surfaces of the pressure contact rollers 13, and a high-quality full-color image free from unevenness in recording density is obtained.

It should be understood that the present invention is not limited to the above-described embodiment, it can be modified in various ways as required. For example, while the roller shaft 14 and the roller body 15 are made of different materials in the embodiment, the present invention is not limited to such a roller structure. The whole pressure contact roller 13 may be integrally formed using a mixed material of the thermoplastic elastomer and the crystalline resin powder 16.

With the pressure contact roller according to one feature of the present invention, as described above, the ink is prevented from drifting from the recording surface, onto which the ink has been transferred, to the pressure contact roller, and a high-quality full-color image free from unevenness in recording density can be obtained.

With the pressure contact roller according to another feature of the present invention, in addition to the advantage according to the above feature, the pressure contact roller can be formed with a simple manufacturing process such that the crystalline resin powder is projected from the outer circumferential surface of the pressure contact roller.

With the pressure contact roller according to still another feature of the present invention, since the hardness of the pressure contact roller can be increased as high as possible within an allowable range, the ink drift can be more effectively prevented in addition to the advantages according to the above features.

With a printer according to still another feature of the present invention, the ink on the recording surface of a sheet of recording paper is more effectively prevented from drifting to the outer circumferential surface of the pressure contact roller, and a high-quality full-color image free from unevenness in recording density can be printed.

What is claimed is:

1. A pressure contact roller for a printer having a feed roller, said pressure contact roller pressure-contacting said feed roller separately provided in said printer and driven for rotation, rotated with rotation of said feed roller, and gripping a sheet of recording paper in cooperation with said feed roller to feed said sheet of recording paper to a recording position, said pressure contact roller pressure-contacting a surface of said sheet of recording paper on the side where printing has been made, and comprising a roller shaft serving as a rotary support shaft and a roller body formed around said roller shaft, said roller body being molded of a mixed material of a thermoplastic elastomer and crystalline resin powder having higher hardness than said elastomer, said crystalline resin powder being mixed at a ratio of 50 to 70 by weight with respect to 100 of said elastomer, said roller body being then polished at a surface thereof, whereby said roller body has an overall outer circumferential surface on which a number of projections are formed by said crystalline resin powder and scattered such that the projections are projected from said outer circumferential surface of said roller body, thereby preventing drift of ink, printed on the surface of said sheet of recording paper on the side where printing has been made, onto said outer circumferential surface of said roller body.

2. A pressure contact roller for a printer according to claim 1, wherein said crystalline resin powder has a mean particle size of 30 $\mu$m.

3. A pressure contact roller for a printer according to claim 1, wherein resin powder of ultrahigh molecular weight polyethylene is used as said crystalline resin powder.

4. A pressure contact roller for a printer according to claim 1, wherein said elastomer material is at least one selected from aramid, a polyester-based elastomer, and a polyamide-based elastomer.

5. A pressure contact roller for a printer according to claim 1, wherein said crystalline resin powder is resin powder made of at least one selected from polyethylene, ultrahigh molecular weight polyethylene, polyimide resin, silicone resin, polyamide resin, polyacetal resin, polyphenylene sulfide (PPS) resin, and fluorocarbon resin.

6. A pressure contact roller for a printer according to claim 1, wherein said elastomer material is a thermoplastic elastomer resin.

7. A printer comprising a feed roller driven by a motor for rotation to feed a sheet of recording paper, and a rotatable pressure contact roller capable of pressure-contacting said feed roller, said feed roller being driven by said motor for rotation in a condition of gripping said sheet of recording paper by said feed roller and said pressure contact roller, thereby feeding said sheet of recording paper to a recording position, said pressure contact roller being positioned to pressure contact a surface of said sheet of recording paper on the side where printing has been made, and comprising a roller shaft serving as a rotary support shaft and a roller body formed around said roller shaft, said roller body being molded of a mixed material of a thermoplastic elastomer resin and crystalline resin powder having higher hardness than said elastomer, said crystalline resin powder being mixed at a ratio of 50 to 70 by weight with respect to 100 of said elastomer, said roller body being then polished at a surface thereof, whereby said roller body has an overall outer circumferential surface on which a number of projections are formed by said crystalline resin powder and scattered such that the projections are projected from said outer circumferential surface of said roller body, thereby preventing drift of ink, printed on the surface of said sheet of recording paper on the side where printing has been made, onto said outer circumferential surface of said roller body, said feed roller being positioned to contact a surface of said sheet of recording paper opposite to the surface where printing has been made, and having an outer circumferential surface in the form of a smooth curved surface to suppress a wear caused by pressure contact of the projections of said pressure contact roller with said feed roller.

8. A printer according to claim 7, wherein said crystalline resin powder has a mean particle size of 30 $\mu$m.

9. A printer according to claim 7, wherein said crystalline resin powder is resin powder made of at least one selected from polyethylene, ultrahigh molecular weight polyethylene, polyimide resin, silicone resin, polyamide resin, polyacetal resin, polyphenylene sulfide (PPS) resin, and fluorocarbon resin.

10. A printer according to claim 7, wherein said elastomer material is a thermoplastic elastomer resin.

11. A printer according to claim 10, wherein said elastomer material is at least one selected from aramid, a polyester-based elastomer, and a polyamide-based elastomer.

* * * * *